US008080156B2

(12) United States Patent
Cross et al.

(10) Patent No.: US 8,080,156 B2
(45) Date of Patent: Dec. 20, 2011

(54) MERCURY REMOVAL FROM CRUDE OIL

(75) Inventors: Joseph B. Cross, Bartlesville, OK (US); Probjot Singh, Bartlesville, OK (US); Richard D. Sadok, Ponca City, OK (US); Howard L. Wilson, Bartlesville, OK (US); John M. Hays, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 42 days.

(21) Appl. No.: 12/538,606

(22) Filed: Aug. 10, 2009

(65) Prior Publication Data

US 2010/0032345 A1 Feb. 11, 2010

Related U.S. Application Data

(63) Continuation-in-part of application No. 12/174,816, filed on Aug. 11, 2008.

(51) Int. Cl.
*C10G 31/00* (2006.01)

(52) U.S. Cl. ..... 208/251 R; 208/13; 208/253; 208/295; 208/296; 208/297; 208/299; 208/302; 208/307; 585/820; 585/849; 585/852; 585/853

(58) Field of Classification Search ..... 208/13, 208/251 R, 253, 295, 296, 297, 299, 302, 208/307; 585/820, 849, 852, 853
See application file for complete search history.

(56) References Cited

U.S. PATENT DOCUMENTS

| | | | | |
|---|---|---|---|---|
| 4,599,177 | A | 7/1986 | Hayashi et al. | |
| 4,693,731 | A * | 9/1987 | Tarakad et al. | 95/188 |
| 4,962,276 | A | 10/1990 | Yan | |
| 4,966,684 | A | 10/1990 | Audeh | |
| 4,981,577 | A | 1/1991 | Audeh et al. | |
| 4,983,277 | A | 1/1991 | Audeh et al. | |
| 4,985,137 | A | 1/1991 | Audeh | |
| 6,350,372 | B1 | 2/2002 | Degnan et al. | |
| 6,475,451 | B1 | 11/2002 | Leppin et al. | |
| 6,537,443 | B1 | 3/2003 | Frankiewicz et al. | |
| 6,770,119 | B2 | 8/2004 | Harada et al. | |
| 7,416,582 | B2 | 8/2008 | Hakka et al. | |
| 7,563,360 | B2 | 7/2009 | Yamaguchi et al. | |
| 2003/0075484 | A1 | 4/2003 | Sakai et al. | |
| 2005/0167335 | A1 | 8/2005 | Yamaguchi | |
| 2007/0278086 | A1 | 12/2007 | Vermeulen | |

FOREIGN PATENT DOCUMENTS

WO WO2006090597 8/2006

OTHER PUBLICATIONS

PCT/US2009/053292 International Search Report (Form PCT/SA/220) dated May 28, 2010.

* cited by examiner

*Primary Examiner* — Prem C Singh

(57) ABSTRACT

Methods and apparatus relate to removal of mercury from crude oil. Such removal relies on transferring mercury from a liquid hydrocarbon stream to a natural gas stream upon contacting the liquid hydrocarbon stream with the natural gas stream. Processing of the natural gas stream after used to strip the mercury from the liquid hydrocarbon stream removes the mercury from the natural gas stream.

16 Claims, 6 Drawing Sheets

MERCURY REMOVAL FROM CRUDE OIL

CROSS-REFERENCE TO RELATED APPLICATIONS

This application is a continuation-in-part of U.S. patent application Ser. No. 12/174,816, filed Aug. 11, 2008, which is herein incorporated by reference.

STATEMENT REGARDING FEDERALLY SPONSORED RESEARCH OR DEVELOPMENT

None

FIELD OF THE INVENTION

Embodiments of the invention relate to processes for removal of mercury from crude oil.

BACKGROUND OF THE INVENTION

Presence of mercury in crude oil can cause problems with downstream processing units as well as health and environmental issues. Such concerns provide incentives to remove the mercury from the crude oil. Therefore, there exists a need for improved processes of removing mercury from crude oil before downstream processing into products.

SUMMARY OF THE INVENTION

In one embodiment, a process of removing mercury from crude oil includes separating a crude oil stream into a gaseous hydrocarbon stream and a liquid hydrocarbon stream and removing mercury from the gaseous hydrocarbon stream to provide a treated gas stream. Contacting the treated gas stream with the liquid hydrocarbon stream transfers mercury from the liquid hydrocarbon stream to the treated gas stream and thereby forms a treated liquid stream and a mercury rich gas stream. The method further includes removing mercury from the mercury rich gas stream.

According to one embodiment, a process includes transferring mercury from a liquid hydrocarbon stream to a natural gas stream. The transferring occurs by contacting the liquid hydrocarbon stream with the natural gas stream to thereby form a treated liquid stream and a mercury rich gas stream. In addition, the method includes removing mercury from the mercury rich gas stream.

For one embodiment, a process includes separating a crude oil stream into a gaseous hydrocarbon stream and a liquid hydrocarbon stream, removing mercury from the gaseous hydrocarbon stream to provide a treated gas stream, and introducing the treated gas stream into contact with the liquid hydrocarbon stream to transfer mercury from the liquid hydrocarbon stream to the treated gas stream and thereby form a treated liquid stream and a mercury rich gas stream. Separating the treated gas stream to remove propane and butane from the treated gas stream occurs prior to contacting the treated gas stream with the liquid hydrocarbon stream. Introducing a pentane-plus vapor stream separated from the treated gas stream into contact with the treated liquid stream enables absorbing the pentane-plus vapor stream into the treated liquid stream. Removing mercury from the mercury rich gas stream provides recycled gas that provides part of the treated gas stream.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to removal of mercury from crude oil. Such removal relies on transferring mercury from a liquid hydrocarbon stream to a natural gas stream upon contacting the liquid hydrocarbon stream with the natural gas stream. Processing of the natural gas stream after used to strip the mercury from the liquid hydrocarbon stream removes the mercury from the natural gas stream. The removal of the mercury from the crude oil provides marketable products and can be performed onsite at well locations, such as offshore platforms with limited space and facilities, prior to transport to refineries. For example, initial production may contain concentrations of mercury above acceptable thresholds or penalty levels for the refineries such that the removal of the mercury reduces or eliminates penalties and otherwise makes the products marketable.

Figure 1:
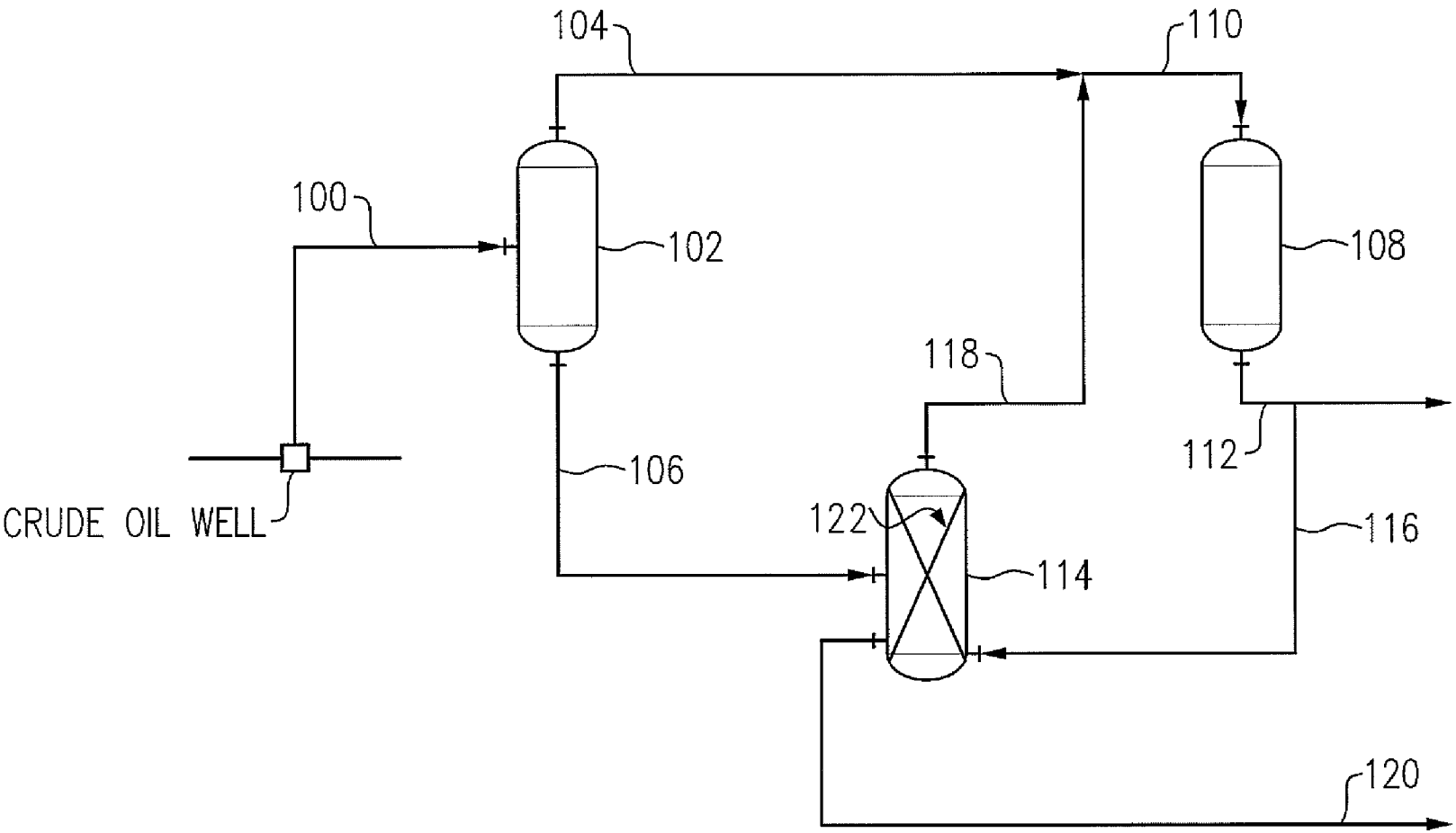
FIG. 1 is a simplified schematic flow diagram of an assembly for removing mercury from crude oil, according to one embodiment.

FIG. 1 illustrates a system in which crude oil is removed from a crude oil well by line 100 and is passed to a separator 102 for separation into a gaseous hydrocarbon stream comprising, consisting of, or consisting essentially of hydrocarbons, mercury and water, which is removed from the separator 102 by line 104, and into a liquid hydrocarbon stream: 1) comprising, consisting of, or consisting essentially of hydrocarbons and elemental mercury, or 2) comprising, consisting of, or consisting essentially of hydrocarbons, elemental mercury and water, which is removed from the separator 102 by line 106. A mercury-containing gas feed, including in part at least a portion of the gaseous hydrocarbon stream, is charged to a mercury removal unit (MRU) 108 by line 110 for removal of mercury from the mercury-containing gas feed, thereby forming a treated gas stream, which is removed from the MRU 108 by line 112. A recycle gas stream comprising a portion of the treated gas stream from the line 112 is charged to a contactor 114 by line 116 for contact with at least a portion of the liquid hydrocarbon stream charged to the contactor 114 by the line 106. Through such contacting, at least a portion of the elemental mercury contained in the liquid hydrocarbon stream is transferred to the recycle gas stream, thereby forming a mercury rich gas stream, which is removed from the contactor 114 by line 118, and a treated liquid hydrocarbon stream, which is removed from the contactor 114 by line 120. The mercury rich gas stream is passed to the MRU 108 as a portion of the mercury-containing gas feed by the lines 118 and 110.

For some embodiments, the contactor 114 includes multiple (e.g., 2, 4, 6 or more) theoretical stages 122 (depicted by "X" within the contactor 114) of separation between vapor and liquid phases. Either trays or packing material in a flow path of fluids described herein passing through the contactor 114 may form the theoretical stages 122. For example, the packing material disposed inside of the contactor 114 to define the stages 122 may include random oriented objects or a shaped structure and may be made of metallic or ceramic solid material. In some embodiments, amount of the packing material utilized depends on a desired number of the stages 122 provided by the packing material.

Figure 2:
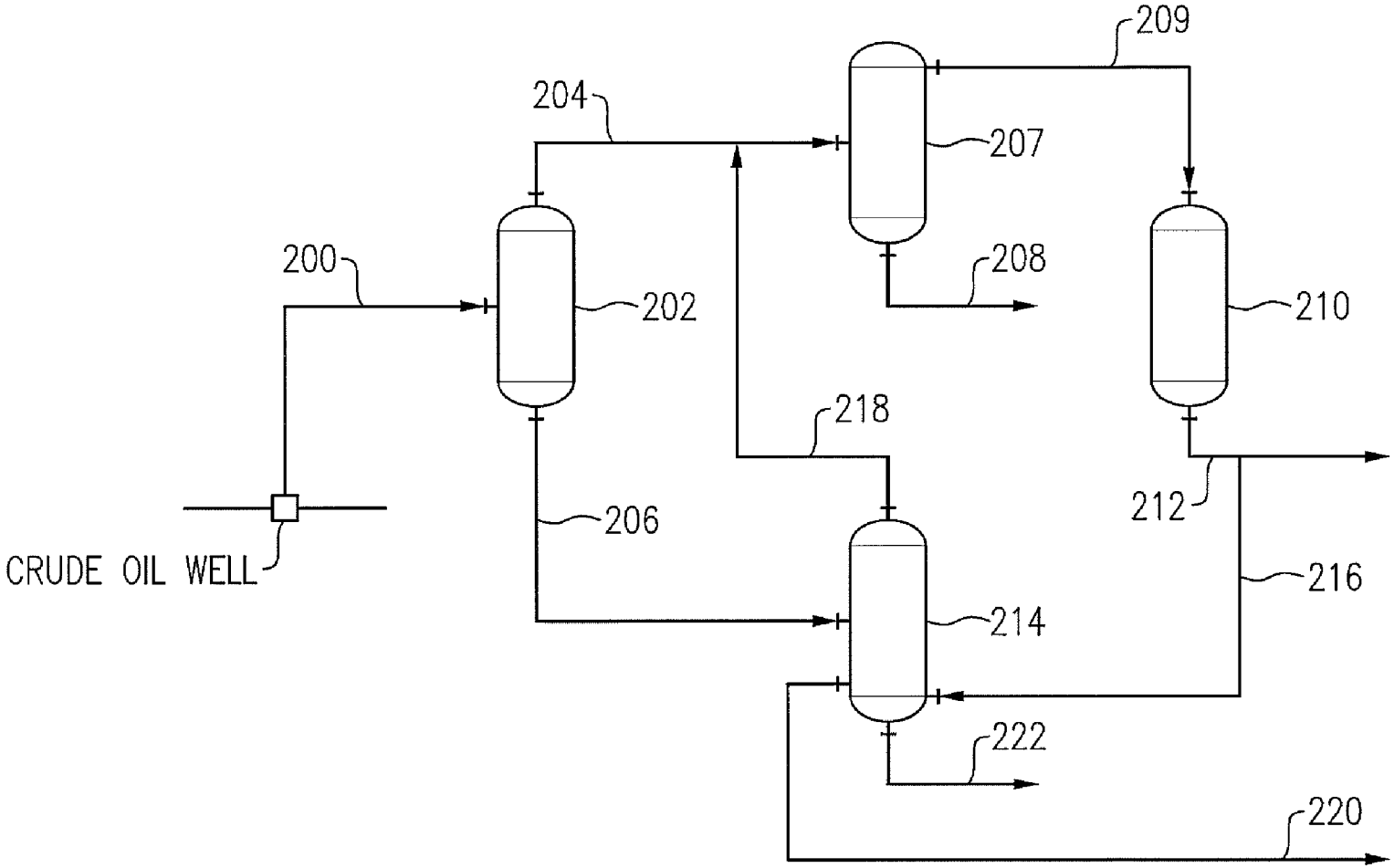
FIG. 2 is a simplified schematic flow diagram of another assembly for removing mercury from crude oil, according to one embodiment.

FIG. 2 shows a system in which crude oil is removed from a crude oil well by line 200 and is passed to a first separator 202 for separation into a gaseous hydrocarbon stream comprising, consisting of, or consisting essentially of hydrocarbons, mercury and water, which is removed from the first separator 202 by line 204, and into a liquid hydrocarbon stream comprising, consisting of, or consisting essentially of hydrocarbons, elemental mercury and water, which is removed from the separator 202 by line 206. Along with a mercury rich gas stream described later, the gaseous hydrocarbon stream is charged to a second separator 207 wherein water is removed and exits the second separator 207 by line 208. Overhead gases leaving the second separator 207 by line 209 are charged to a mercury removal unit (MRU) 210 as a mercury-containing gas feed for removal of mercury from the mercury-containing gas feed, thereby forming a treated gas stream, which is removed from the MRU 210 by line 212. A recycle gas stream comprising a portion of the treated gas stream from line 212 is charged to a contactor 214 by line 216 for contact with at least a portion of the liquid hydrocarbon stream charged to the contactor 214 by the line 206. Through such contacting, at least a portion of the elemental mercury contained in the liquid hydrocarbon stream is transferred to the recycle gas stream, thereby forming a mercury rich gas stream, which is removed from the contactor 214 by line 218, and a treated liquid hydrocarbon stream, which is removed from the contactor 214 by line 220. The mercury rich gas stream is passed to the second separator 207 along with the gaseous hydrocarbon stream by the lines 218 and 204. In addition, water is separated from the liquid hydrocarbon stream (and from the recycle gas stream, if water is present in such) and removed from the contactor 214 by line 222. For some embodiments, a third separator is included in between the first separator 202 and the contactor 214 to separate water from the liquid hydrocarbon stream 206. In some embodiments, a heat exchanger is included after the first separator 202 to increase temperature of the liquid hydrocarbon stream and achieve adequate separation of water from the liquid hydrocarbon stream 206.

Figure 5:
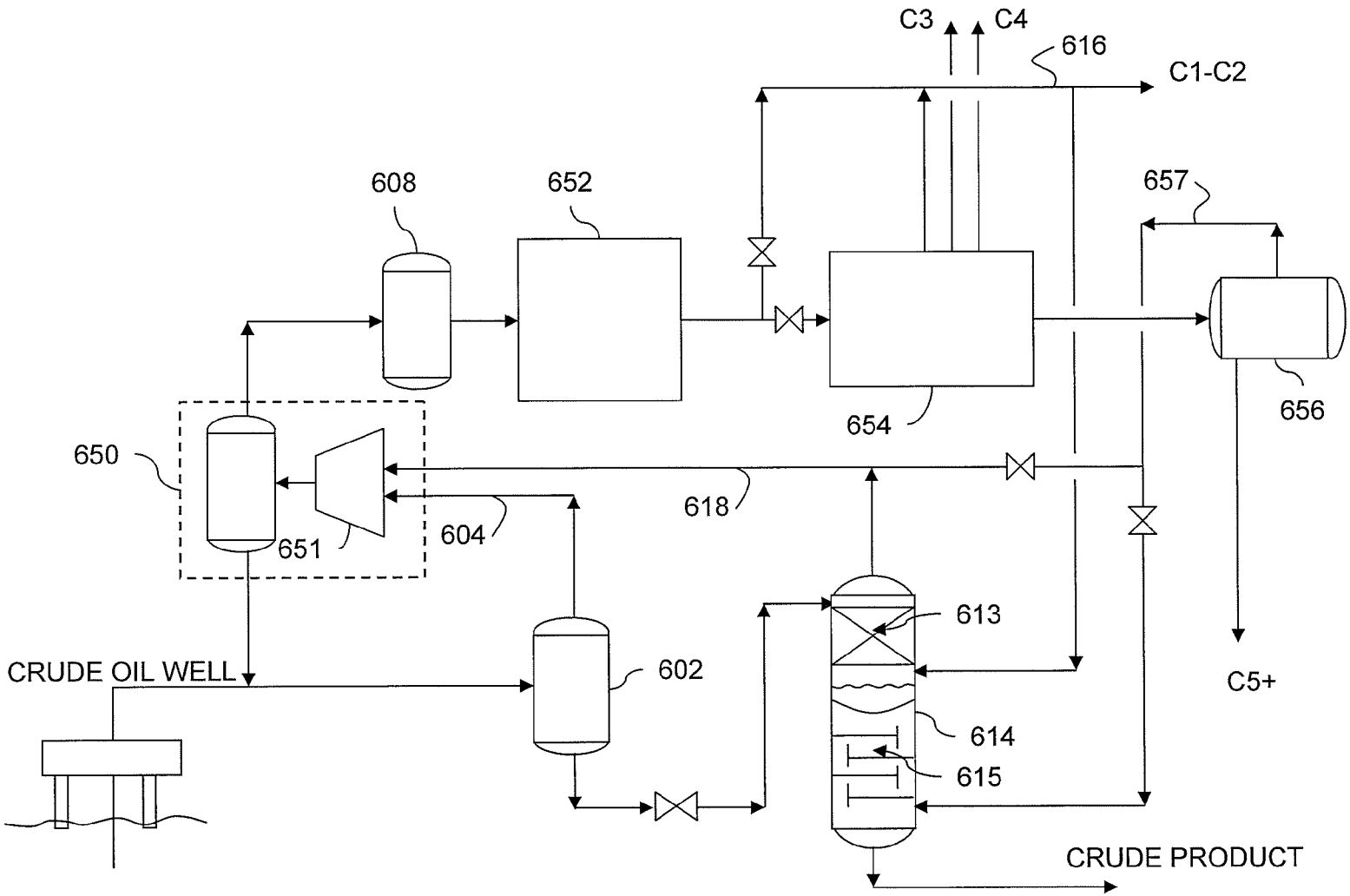
FIG. 5 is a simplified schematic flow diagram of an assembly for removing mercury from crude oil and absorbing hydrocarbon vapors back into the crude oil, according to one embodiment.

FIG. 5 illustrates a system that includes a separator 602, a MRU 608 and a contactor 614, which operate to remove mercury from a crude oil stream as described herein. For some embodiments, another separator is included in between the separator 602 and the contactor 614 to separate water from the liquid hydrocarbon stream. The system further includes a compression and recovery unit 650, a dryer 652, a gas separating unit 654 and a condenser 656 coupled together to facilitate processing associated with removal of the mercury. While only one compressor 651 is shown as part of the recovery unit 650, the compressor 651 may be part of a series of compression, heat exchange and separation within the recovery unit 650 that receives a gaseous hydrocarbon stream 604 from the separator 602 and/or a mercury rich gas stream 618 from the contactor 614. Output from the recovery unit 650 feeds gasses to the MRU 608 and recycles liquids back through the separator 602.

The dryer 652 removes water vapor from the gasses that pass through the MRU 608, or are introduced into the MRU 608 for embodiments with the dryer located ahead of the MRU 608, prior to the gasses being introduced into the gas separating unit 654. The gas separating unit 654 separates the gasses treated in the MRU 608 into: 1) a propane stream denoted as C3, 2) a butanes stream depicted as C4, 3) a product gas stream 616 that includes methane and ethane (C1-C2), and 4) a pentane-plus gas stream that feeds into the condenser 656 and includes hydrocarbons having at least five carbon atoms per molecule. A portion of the product gas stream 616 enters into a stripping zone 613 of the contactor 614 to achieve the removal of mercury from liquids passing through the contactor 614. In some embodiments, any portion or all of the product gas stream 616 introduced into the stripping zone 613 may bypass separation (i.e., removal of propane, butane and/or pentane-plus) and still achieve mercury and/or propane and butane stripping from the liquids passing through the stripping zone 613 of the contactor 614 as described herein.

The pentane-plus gas stream introduced into the condenser 656 condenses and is separated into vapors that include pentanes and higher molecular weight hydrocarbons output from the condenser 656 as a blend component stream 657 and liquids (identified as C5+) including hydrocarbons having at least five carbon atoms per molecule. At least a portion of the blend component stream 657 enters into an absorption zone 615 contained in the contactor 614 for transfer of at least a portion of the vapors within the blend component stream 657 to a treated liquid hydrocarbon stream from the stripping zone 613, thereby forming an enriched treated liquid hydrocarbon stream. The absorption zone 615 provides contact surface area, mixing and residence time sufficient (e.g., via packing material and/or trays shown in FIG. 5) to absorb at least a portion of the pentanes and higher molecular weight hydrocarbons contained in the blend component stream 657 into the treated liquid hydrocarbon stream. The absorption zone 615 is located in the contactor 614 at a location below the stripping zone 613 such that the treated liquid hydrocarbon stream flows from the stripping zone 613 to the absorption zone 615. The enriched treated liquid hydrocarbon stream provides crude product removed from the contactor 614.

Since propane and butane are stripped from the crude oil stream in the stripping zone 613 of the contactor 614, blending back in contents of the blend component stream 657 in the absorption zone 615 of contactor 614 can occur without exceeding a threshold for vapor pressure in the crude product. Further, utilizing the absorption zone 615 enables limiting amount of the blend component stream 657 that is combined with the mercury rich gas stream 618 entering the recovery unit 650 since the compressor 651 may have limited capacity. Sufficient quantities of the product gas stream 616 can thus pass through the contactor 614 and exit as the mercury rich gas stream 618 to achieve desired reductions in the mercury content within the crude product without overwhelming the capacity of the compressor 651 that receives the mercury rich gas stream 618.

The crude oil stream in some embodiments comprises, consists of, or consists essentially of a broad range crude oil. For example, the crude oil stream may include hydrocarbons containing at least one carbon atom per molecule. The gaseous hydrocarbon stream comprises, consists of, or consists essentially of hydrocarbons containing from about 1 to about 6 carbon atoms per molecule.

In some embodiments, the temperature at which the crude oil stream is separated into the gaseous hydrocarbon stream and the liquid hydrocarbon stream is at least about 50° C. or at least about 60° C. The pressure at which the crude oil stream is separated into the gaseous hydrocarbon stream and the liquid hydrocarbon stream is at least about 0.5 Bars or at least about 1 Bars, for some embodiments.

The mercury removal unit has a fixed bed comprising any mercury sorbent material capable of removing mercury from gases. In some embodiments, the treated gas stream comprises less than about 20 wt. % of the mercury contained in the mercury-containing gas feed or less than about 10 wt. % of the mercury contained in the mercury-containing gas feed. The treated liquid hydrocarbon stream may comprise less than about 50 wt. % of the elemental mercury contained in the liquid hydrocarbon stream or less than about 20 wt. % of the elemental mercury contained in the liquid hydrocarbon stream. The liquid hydrocarbon stream for some embodiments comprises at least about 10 ppb elemental mercury or comprises at least about 200 ppb elemental mercury.

The recycle gas stream is contacted with the liquid hydrocarbon stream at a temperature in the range of from about 70° C. to about 300° C. or from about 150° C. to about 200° C.; a pressure in the range of from about 0.5 Bars to about 15 Bars, from about 1 Bar to about 10 Bars, or from about 2 Bars to about 7 Bars; and a gas to liquid ratio in the range of from about 50 to about 300 standard cubic feet of gas/bbl of liquid (SCF/bbl) or from about 100 to about 200 SCF/bbl.

The following examples are provided to further illustrate this invention and are not to be considered as limiting the scope of this invention.

EXAMPLES

Example 1

Figure 3:
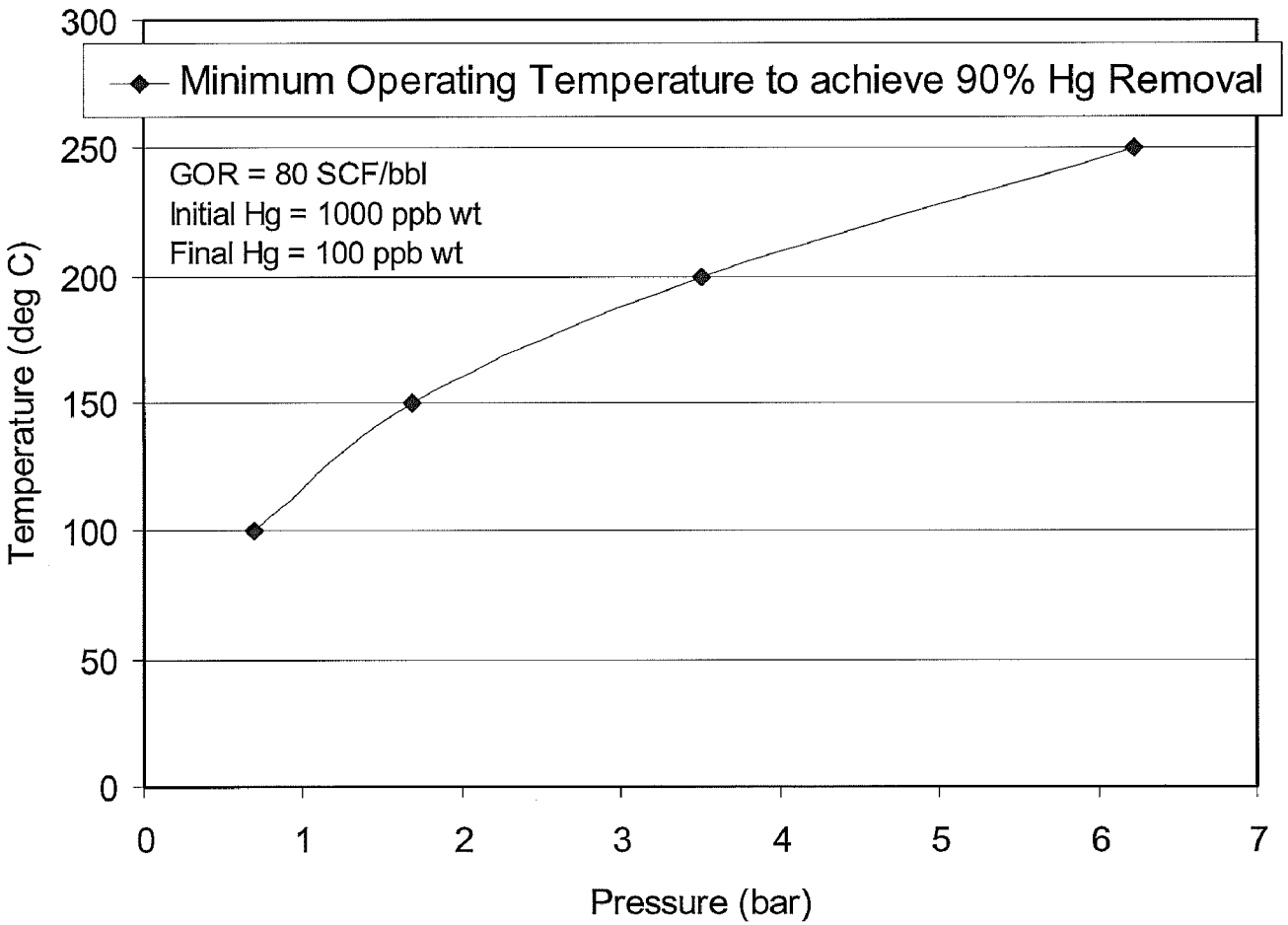
FIG. 3 is a graphic illustration of a temperature versus pressure curve, resulting from a simulation, above which temperature 90% mercury removal from a crude oil is predicted.

A simulation of the liquid/gas contactor was constructed using an equation of state thermodynamic prediction model for mercury partitioning between gas and liquid using data for elemental mercury in a naturally obtained crude oil blend. Results of the calculation are shown in FIG. 3, wherein the temperature of the crude oil is plotted against the pressure to achieve 90% removal of mercury from the liquid oil feed to the contactor. A gas to oil ratio of 80 SCF/bbl was used in the model.

Common pressure of a Low Pressure Coalescer/Separator present at the well site (which is redeployed as set forth herein as a gas/oil contactor) ranges from about <1 to ~3 Bars. In typical applications, reservoir temperature of high mercury crude oils is greater than about 150° C. This simulation thus shows that 90% mercury removal is achievable at the temperature and pressure conditions often present at the crude oil well site.

Example 2

Figure 4:
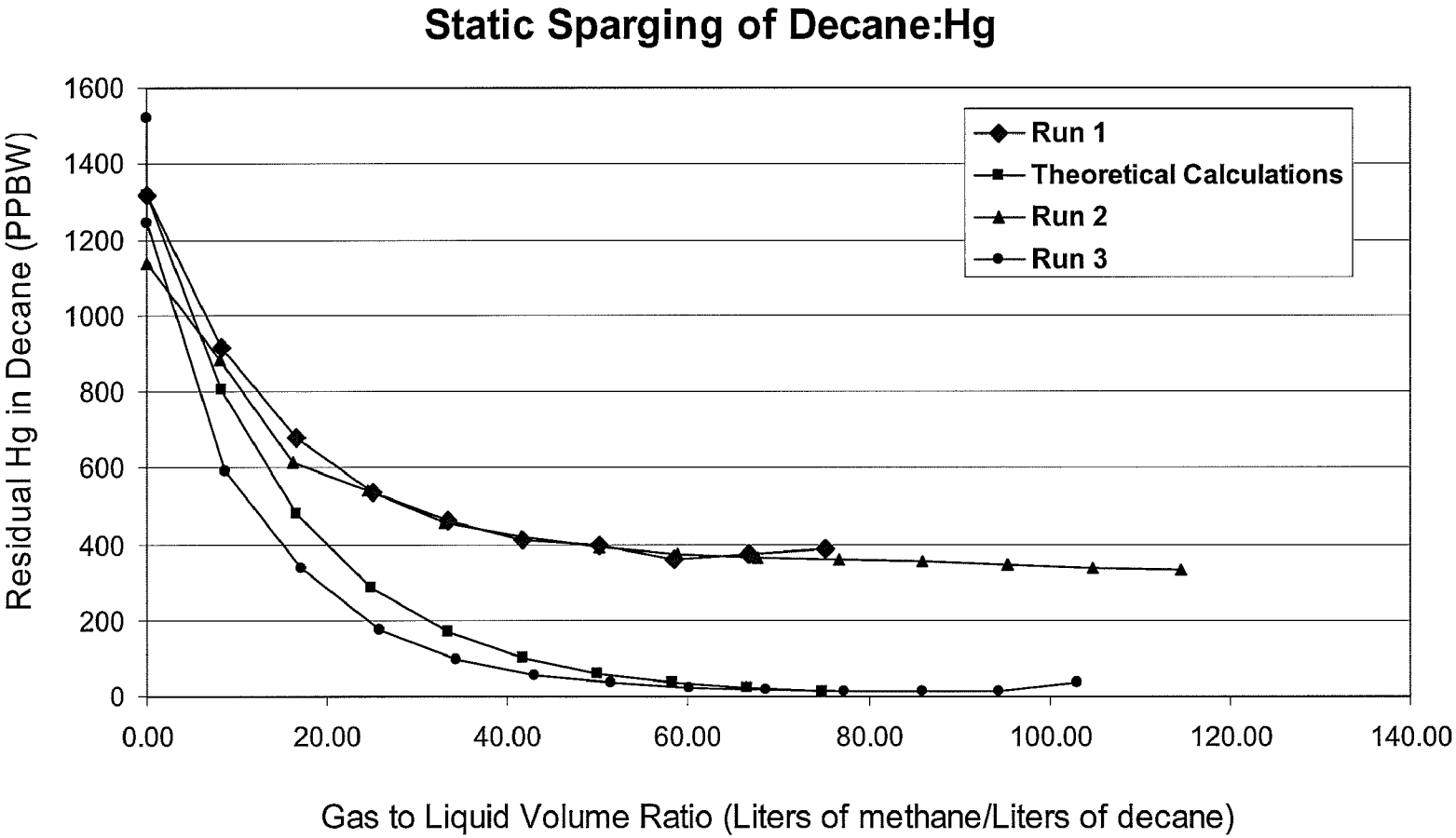
FIG. 4 is a graphic illustration of results from experiments concerning the removal of mercury from decane using methane as a sparging media.

An experiment was run to test the removal of elemental mercury (Hg) from a hydrocarbon by sparging with a lighter hydrocarbon. The elemental mercury was dissolved in decane at about 1,300 ppbw. FIG. 4 shows the results of the experiment, plotting residual Hg in the decane versus liters of methane sparged through the decane for two different runs, Runs 1 and 2.

A third experiment (Run 3) was performed wherein, prior to adding the elemental mercury, the decane was water washed and passed over a silica gel column to remove trace levels of chloride, oxide or sulfur compounds that could, at the conditions of the experiment, oxidize the mercury and cause it to form non-spargable mercury compounds. Also shown in FIG. 4 is a plot of the results of theoretical calculations of the mercury removal process. The plot shows that the experimental results for Runs 1 and 2 are in good agreement with the theoretical calculations and that the experimental results for Run 3 are in excellent agreement with the theoretical calculations.

Example 3

Figure 6:
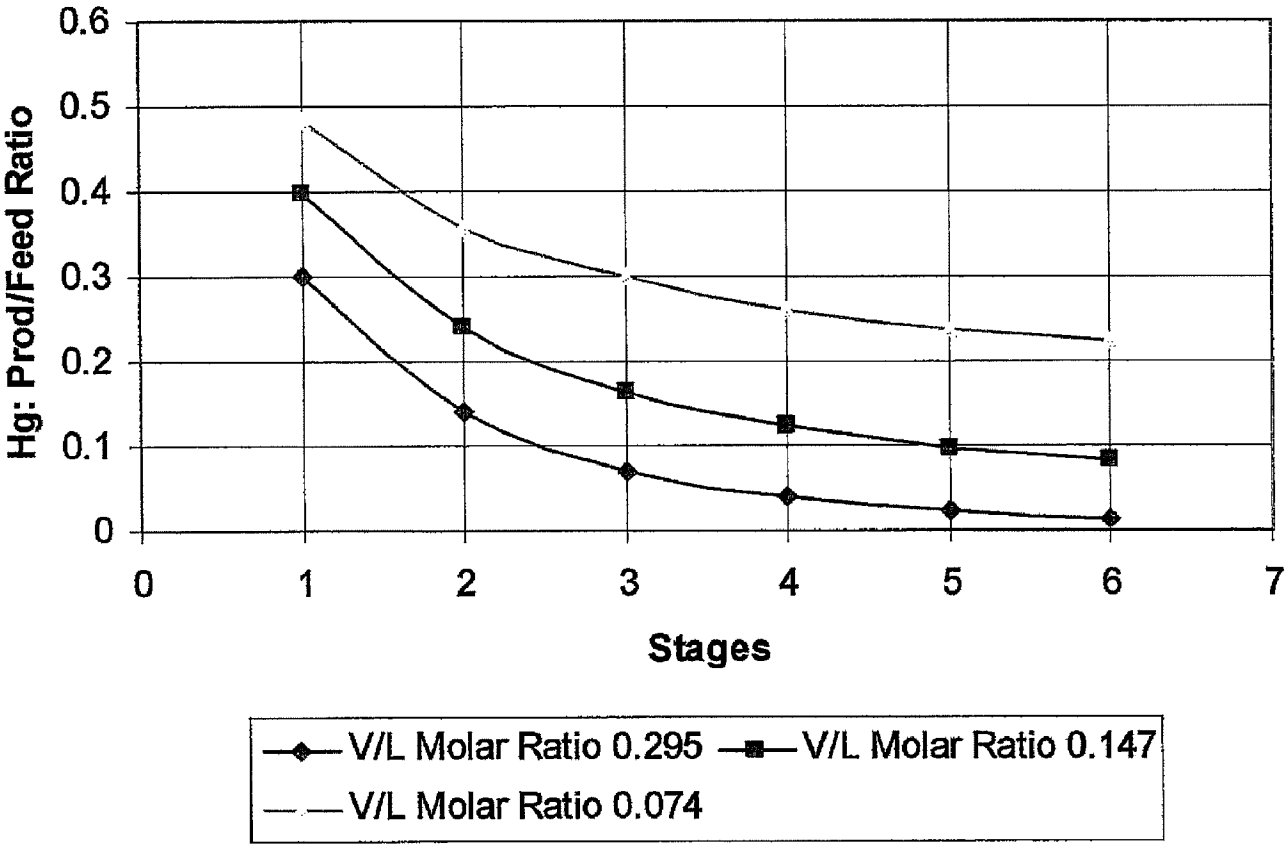
FIG. 6 is a graphic illustration of computer simulation results of ratio of mercury in liquid product to mercury in liquid feed versus number of theoretical stages in a gas/liquid contactor used for removing mercury, according to one embodiment.

A simulation was run in order to evaluate affect of the number of theoretical stages (e.g., as indicated by reference number 122 in FIG. 1) on mercury removal. Various vapor/liquid (V/L) molar ratios of gas to hydrocarbon liquid were used in the simulations (0.295, 0.147 and 0.074). Results of the model are shown in FIG. 6 and demonstrate that for all V/L molar ratios increasing the number of theoretical stages results in increased mercury removal. For instance, increasing the number of theoretical stages from 1 to 5 increased the mercury removal by a factor of four.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A process comprising:

separating a crude oil stream into a gaseous hydrocarbon stream and a liquid hydrocarbon stream at a recovery unit at a temperature of at least 50° C.;

removing mercury from the gaseous hydrocarbon stream to provide a treated gas stream at a mercury removal unit;

contacting the treated gas stream with the liquid hydrocarbon stream to transfer mercury from the liquid hydrocarbon stream to the treated gas stream and thereby form a treated liquid stream and a mercury rich gas stream at a contactor at a temperature range greater than 150° C.;

removing mercury from the mercury rich gas stream;

wherein the recovery unit, the mercury removal unit and the contactor are separate units and the contactor removes propane and butane in a stripping zone;

wherein mercury removal is greater than 90%; and wherein the contacting of the treated gas stream with the liquid hydrocarbon stream occurs in a vessel that provides direct contact of the treated gas stream with the liquid hydrocarbon stream without contacting any other materials or devices.

2. The process according to claim 1, further comprising separating the treated gas stream to form a pentane-plus vapor stream introduced into contact with the treated liquid stream for absorbing into the treated liquid stream.

3. The process according to claim 2, wherein the contacting of the treated gas stream with the liquid hydrocarbon stream further strips propane and butane from the liquid hydrocarbon stream to reduce propane and butane content in the treated liquid stream relative to the liquid hydrocarbon stream.

4. The process according to claim 1, further comprising separating the treated gas stream to remove propane and butane from the treated gas stream prior to contacting the treated gas stream with the liquid hydrocarbon stream.

5. The process according to claim 1, further comprising:

separating out a pentane-plus vapor stream from the treated gas stream; and introducing the pentane-plus vapor stream into contact with the treated liquid stream for absorbing into the treated liquid stream, wherein introducing the treated gas stream into contact with the liquid hydrocarbon stream and introducing the pentane-plus vapor stream into contact with the treated liquid stream occur at separate locations.

6. The process according to claim 1, wherein removing mercury from the mercury rich gas stream provides recycled gas providing a portion of the treated gas stream.

7. The process according to claim 1, wherein removing mercury from the gaseous hydrocarbon stream and removing mercury from the mercury rich gas stream comprises introducing the gaseous hydrocarbon stream and the mercury rich gas stream into a mercury-sorbent based removal unit.

8. The process according to claim 1, wherein contacting the treated gas stream with the liquid hydrocarbon stream transfers elemental mercury from the liquid hydrocarbon stream to the treated gas stream.

9. The process according to claim 1, wherein the treated hydrocarbon stream contains less than 10 weight percent of elemental mercury contained in the liquid hydrocarbon stream.

10. A process comprising:

transferring mercury from a liquid hydrocarbon stream to a natural gas stream upon contacting the liquid hydrocarbon stream with the natural gas stream and thereby forming a treated liquid stream and a mercury rich gas stream at a contactor at a temperature range greater than 150° C.;

removing mercury from the mercury rich gas stream;

the contactor removes propane and butane in a stripping zone;

wherein mercury removal is greater than 90%; and wherein the contacting of the treated gas stream with the liquid hydrocarbon stream occurs in a vessel that provides direct contact of the treated gas stream with the liquid hydrocarbon stream without contacting any other materials or devices.

11. The process according to claim 10, wherein removing mercury from the mercury rich gas stream provides treated gas forming a portion of the natural gas stream.

12. The process according to claim 10, further comprising:

separating a hydrocarbon gas stream into the natural gas stream and a pentane-plus gas stream; and absorbing the pentane-plus gas stream into the treated liquid stream.

13. The process according to claim 10, wherein the natural gas stream has a lower mercury concentration than the liquid hydrocarbon stream prior to contacting the liquid hydrocarbon stream with the natural gas stream.

14. A process comprising:

separating a crude oil stream into a gaseous hydrocarbon stream and a liquid hydrocarbon stream at a recovery unit at a temperature of at least 50° C.;

removing mercury from the gaseous hydrocarbon stream to provide a treated gas stream at a mercury removal unit;

introducing the treated gas stream into contact with the liquid hydrocarbon stream to transfer mercury from the liquid hydrocarbon stream to the treated gas stream and thereby form a treated liquid stream and a mercury rich gas stream at a contactor at a temperature range greater than 150° C.;

introducing a pentane-plus vapor stream separated from the treated gas stream into contact with the treated liquid stream for absorbing into the treated liquid stream;

removing mercury from the mercury rich gas stream to provide recycled gas that provides part of the treated gas stream;

wherein the recovery unit, the mercury removal unit and the contactor are separate units and the contactor removes propane and butane in a stripping zone;

wherein mercury removal is greater than 90%; and wherein the contacting of the treated gas stream with the liquid hydrocarbon stream occurs in a vessel that provides direct contact of the treated gas stream with the liquid hydrocarbon stream without contacting any other materials or devices.

15. The process according to claim 14, wherein introducing the treated gas stream into contact with the liquid hydrocarbon stream and introducing the pentane-plus vapor stream into contact with the treated liquid stream occur in separate sections of a contact vessel.

16. The process according to claim 14, wherein the introducing of the treated gas stream into contact with the liquid hydrocarbon stream further strips propane and butane from the liquid hydrocarbon stream to reduce propane and butane content in the treated liquid stream relative to the liquid hydrocarbon stream.

* * * * *